US009382104B2

(12) United States Patent
Kreutzer

(10) Patent No.: US 9,382,104 B2
(45) Date of Patent: Jul. 5, 2016

(54) TRAILER LIFT AND STORAGE APPARATUS

(71) Applicant: Gregory S. Kreutzer, Commerce, MI (US)

(72) Inventor: Gregory S. Kreutzer, Commerce, MI (US)

( * ) Notice: Subject to any disclaimer, the term of this patent is extended or adjusted under 35 U.S.C. 154(b) by 0 days.

(21) Appl. No.: 14/550,067

(22) Filed: Nov. 21, 2014

(65) Prior Publication Data

US 2015/0136930 A1 May 21, 2015

Related U.S. Application Data

(60) Provisional application No. 61/907,151, filed on Nov. 21, 2013.

(51) Int. Cl.

| | |
|---|---|
| ***B66F 7/28*** | (2006.01) |
| ***B66F 7/24*** | (2006.01) |
| ***B66F 7/16*** | (2006.01) |
| ***B66F 7/18*** | (2006.01) |
| ***B66F 7/20*** | (2006.01) |

(52) U.S. Cl.

CPC . *B66F 7/243* (2013.01); *B66F 7/16* (2013.01); *B66F 7/18* (2013.01); *B66F 7/20* (2013.01)

(58) Field of Classification Search

CPC ..... B60S 9/02; B66F 7/243; B66F 7/16; B66F 7/18; B66F 7/20; E21D 15/02

USPC ..... 248/346.01, 352, 351, 188.1; 254/88; 14/69.5; 414/537; 280/764.1; 187/203, 187/205, 218, 219

See application file for complete search history.

(56) References Cited

U.S. PATENT DOCUMENTS

| | | | | | |
|---|---|---|---|---|---|
| 2,491,718 | A * | 12/1949 | Densmore | 254/88 | |
| 2,631,007 | A * | 3/1953 | Copus | B66F 7/243 | 254/88 |
| 2,690,235 | A * | 9/1954 | Hott | B66F 7/18 | 187/219 |
| 3,106,988 | A * | 10/1963 | Hott | B66F 7/20 | 187/203 |
| 3,298,665 | A * | 1/1967 | Sieloff | B66F 3/005 | 254/94 |
| 3,347,342 | A * | 10/1967 | Hott | B66F 7/16 | 187/205 |
| 3,405,781 | A * | 10/1968 | Brown | B66F 7/025 | 187/210 |
| 4,058,292 | A * | 11/1977 | Goodrich et al. | 254/88 | |
| 4,165,862 | A * | 8/1979 | Bennett | 254/88 | |
| 4,542,881 | A * | 9/1985 | Naylor | 254/88 | |
| 4,993,685 | A * | 2/1991 | Sparling | 254/88 | |
| D347,502 | S * | 5/1994 | Mazza | D34/32 | |
| 6,439,543 | B1 * | 8/2002 | Peckham | 254/88 | |
| 6,471,009 | B1 * | 10/2002 | Mabry | B66F 7/20 | 187/218 |
| 6,708,361 | B1 * | 3/2004 | Emerson, Jr. | 14/69.5 | |
| 6,837,669 | B2 * | 1/2005 | Reed et al. | 414/537 | |
| 7,073,777 | B2 * | 7/2006 | Branstetter | 254/88 | |
| 7,222,838 | B1 * | 5/2007 | Ji | 254/88 | |
| 7,631,897 | B2 * | 12/2009 | Kartiala | 280/764.1 | |
| 2003/0072641 | A1 * | 4/2003 | Reed et al. | 414/537 | |

* cited by examiner

*Primary Examiner* — Anita M King

(74) *Attorney, Agent, or Firm* — Dinsmore & Shohl LLP

(57) ABSTRACT

A lifting and storage assembly for a trailer includes a pair of spaced parallel rails disposed on a surface. The rails support an axle of the trailer wherein the wheels of the trailer are lifted above the surface removing a load on the wheels. Each of the pair of spaced rails includes a contoured top surface. The contoured top surface extends from a proximal end to a distal end with a middle portion positioned there between. The proximal end of the contoured top surface includes a ramped structure including an angle defining a travel path of the axle on the contoured top surface. The proximal end of the contoured top surface terminates at a radius that transition to the middle portion having a planar surface.

13 Claims, 6 Drawing Sheets

TRAILER LIFT AND STORAGE APPARATUS

CROSS-REFERENCE TO RELATED APPLICATIONS

This application claims priority of U.S. Provisional Application 61/907,151 filed Nov. 21, 2013, the contents of which are incorporated herein by reference.

FIELD OF THE INVENTION

The invention relates to trailer lifting and storing apparatuses.

BACKGROUND OF THE INVENTION

Storage of a trailer with a load may subject tires, wheels and bearings of the trailer to stationary heavy loads. Such heavy loads on a stationary trailer may cause the tires to become deformed or have an out of round shape that may cause unwanted vibrations and noise when traveling on a road surface when the trailer is in use. Additionally, storage of a loaded trailer may also cause the bearings of the wheel mechanism of the trailer to become deformed leading to wear of the bearings and causing costly replacement of the bearings. Further, storage of loaded trailer may also cause dry rotting of the tires of a trailer.

There is therefore a need in the art for a trailer lift and storage apparatus that removes the load from the wheels and tires on a stationary stored trailer. There is also a need in the art for a trailer lift and storage apparatus that may be utilized with a variety of trailers of various sizes and capacities.

SUMMARY OF THE INVENTION

In one aspect there is disclosed a lifting and storage assembly for a trailer that includes a pair of spaced parallel rails disposed on a surface. The rails support an axle of the trailer wherein the wheels of the trailer are lifted above the surface removing a load on the wheels.

In another aspect there is disclosed a lifting and storage assembly for a trailer including a pair of spaced parallel rails disposed on a surface. The rails support an axle of the trailer wherein the wheels of the trailer are lifted above the surface removing a load on the wheels. Each of the pair of spaced rails includes a contoured top surface. The contoured top surface extends from a proximal end to a distal end with a middle portion positioned there between.

In a further aspect there is disclosed a lifting and storage assembly for a trailer including a pair of spaced parallel rails disposed on a surface. The rails support an axle of the trailer wherein the wheels of the trailer are lifted above the surface removing a load on the wheels. Each of the pair of spaced rails includes a contoured top surface. The contoured top surface extends from a proximal end to a distal end with a middle portion positioned there between. The proximal end of the contoured top surface includes a ramped structure including an angle defining a travel path of the axle on the contoured top surface. The proximal end of the contoured top surface terminates at a radius that transition to the middle portion having a planar surface.

DETAILED DESCRIPTION OF THE PREFERRED EMBODIMENTS

Figure 1:
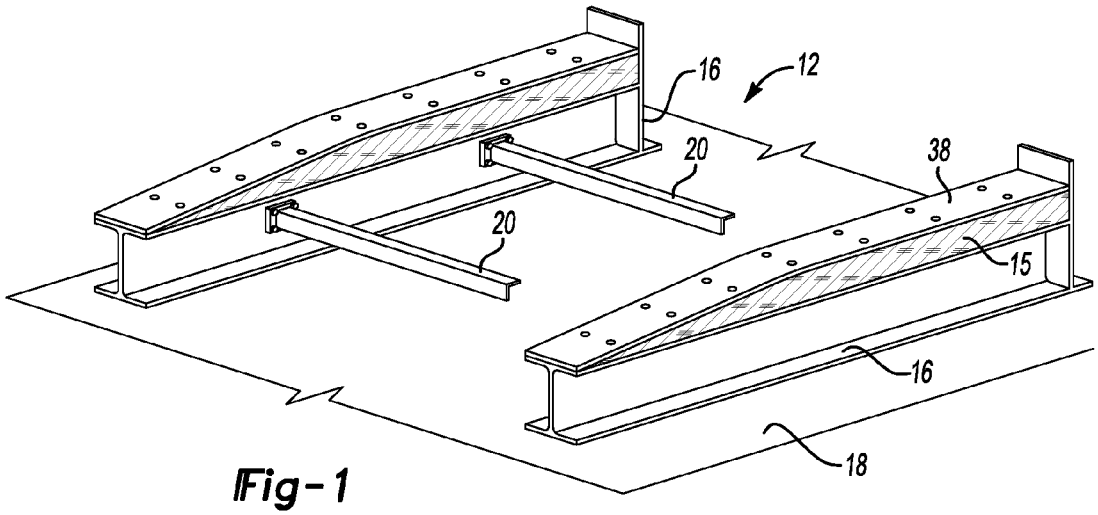
FIG. 1 is a perspective pictorial view of a lifting and storage apparatus.

Referring to the Figures, there is disclosed a lifting and storage apparatus 12 for a trailer 14. The lifting and storage apparatus 12 includes a pair of parallel spaced rails 16 disposed on a surface 18. The rails 16 may be spaced from each other at various distances to accommodate trailers 14 with various wheel base dimensions. The rails 16 may include cross members 20 linking the parallel rails 16, as will discussed in more detail below.

Figure 2:
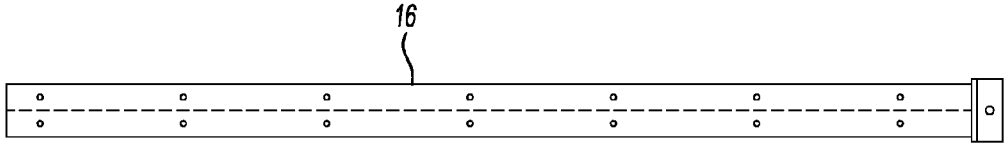
FIG. 2 is a plan view of a rail of the lifting and storing apparatus.
Figure 3:
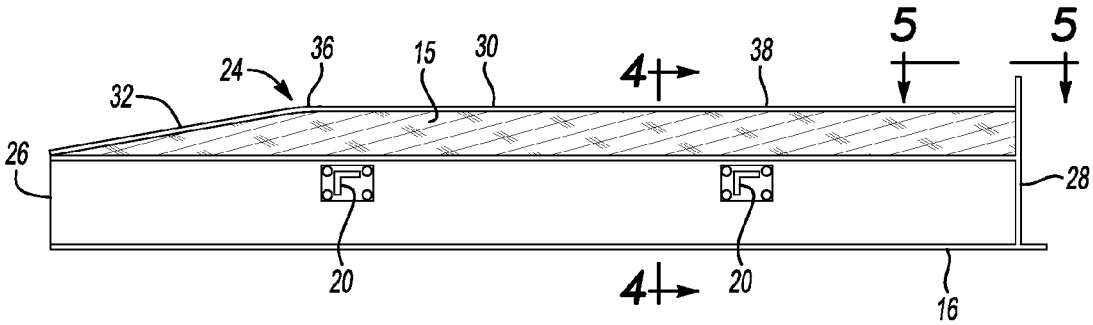
FIG. 3 is side view of a rail of the lifting and storing apparatus.
Figure 4:
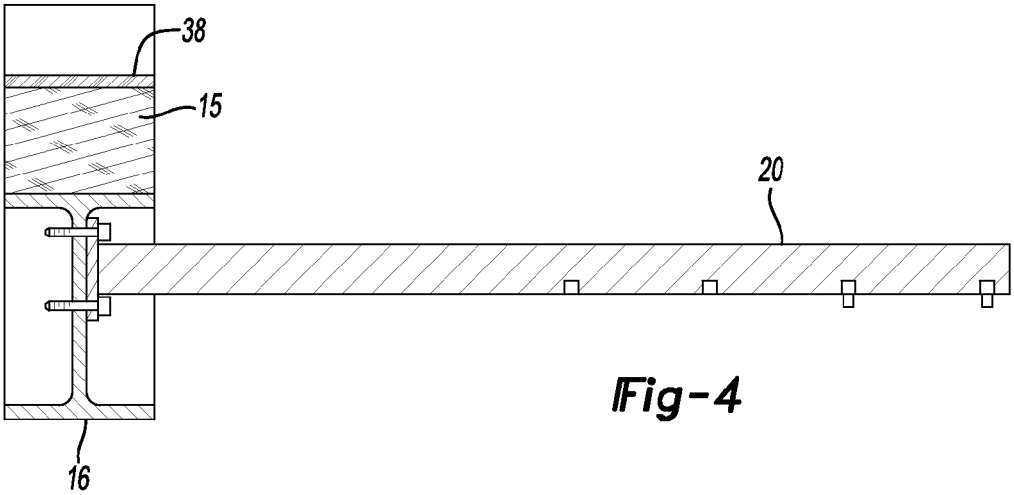
FIG. 4 is sectional view of a rail of the lifting and storing apparatus taken along the line A-A of FIG. 3.
Figure 6:
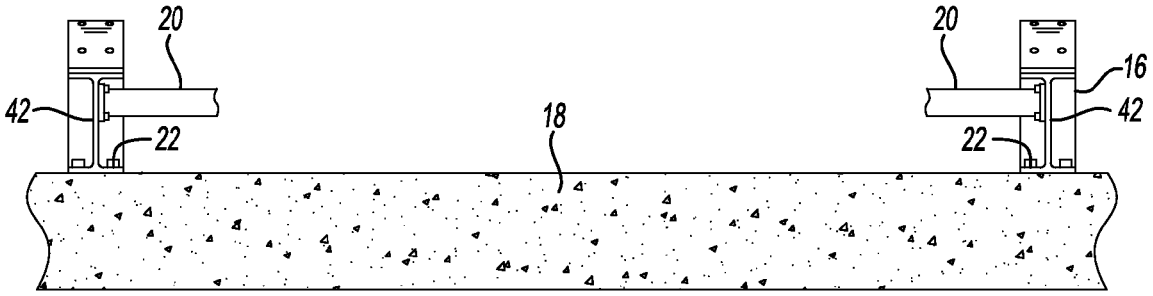
FIG. 6 is a partial section view of an attachment of the lifting and storage apparatus to a surface.

Referring to FIGS. 1-3, the rails 16 may have a rectangular profile when viewed from the top as shown in FIG. 1. The rails 16 may be formed of various materials including metal and structural types of materials capable of supporting a heavy load such a wood, plastics and composite materials. In one aspect the rails 16 may have an I-beam type of structure and may be formed of steel. The rail may be attached to the surface utilizing fasteners 22 as shown in FIGS. 1 and 6. Various types of fasteners may be utilized including screws, bolts, and anchors or pins as shown in FIG. 6. Alternatively, a non skid material such as paint or other material may be applied to the surface to maintain a position of the rail 16 on the surface 18. The rail 16 may also include an extension member 15 attached thereon that may increase the height of the rail 16.

Referring to FIGS. 1 and 3, the rails 16 may include a contoured top surface 24. The contoured top surface may be formed on the extension member 15 as depicted or may be formed on the rails 16. The contoured top surface 24 includes a proximal end 26 and a distal end 28 separated by a middle portion 30. In one aspect the proximal end 26 includes a ramped structure 32 with an angle that defines the travel path of an axle 34 on the rails 16 as will be discussed in more detail below. The angle may vary to provide a gradual increase in the height of the top surface 24 along the rail 16 from the proximal to distal ends 26, 28 of the top surface 24. The proximal end 26 of the rail 16 ends at a radius 36 that transition to a planar flat middle portion 30 of the top surface 24. The planar portion of the top surface 24 defines the height that a wheel and tire will be lifted off the surface 18. The planar flat middle portion 30 continues to the distal end 28 of the top surface 24. The distal end 28 may include a stop or other such structure to limit the travel path of the axle or no stop may be formed at the distal end 28 of the top surface 24.

The top surface 24 may include a sliding plate 38 attached thereon to provide a smooth travel of an axle 34 of the trailer on the rails 16. The sliding plate 38 may be formed of various materials including plastics and composites that include Teflon or other types of materials that lessens a friction coefficient of the top surface 24 and axle 34 allowing smooth travel of an axle 34 of the trailer on the top surface 24. The sliding plate 38 may be attached to the rails 16 utilizing fasteners or may otherwise be attached to the rails 16 using adhesives, welding or other joining techniques.

Figure 5:
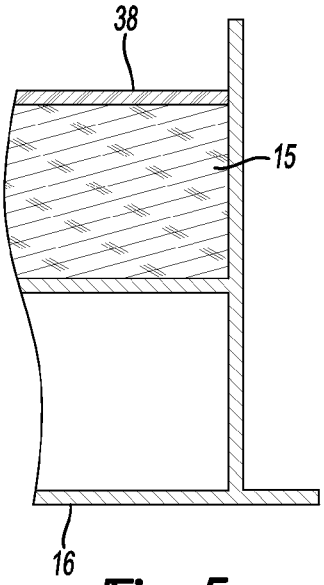
FIG. 5 is sectional view of a rail of the lifting and storing apparatus taken along the line B-B of FIG. 3.

Referring to FIGS. 3-5 and 7-8, the lifting and storage apparatus 12 may include at least one cross member 20 that connects to each of the parallel rails 16. In one aspect the at least one cross members 20 are adjustable such that the rails 16 may be separated from each other over various distances to accommodate a variety of trailers. The cross member 20 may be attached to the rails 16 utilizing angled members 42 and fasteners as shown in FIG. 3 and FIG. 5. Each of the rails 16 may include one or two cross members 20 attached thereon, with two being shown in the depicted embodiment of FIG. 7. The cross members 20 of the opposing parallel rails 16 may be adjusted and joined to the opposing cross member 20 to adjust the spacing between the rails 16. In one aspect, the cross members 20 may be joined to each other utilizing fasteners such as bolts and locking nuts 46, 48 that are passed through slots 50 formed in the cross members 20.

Figure 7:
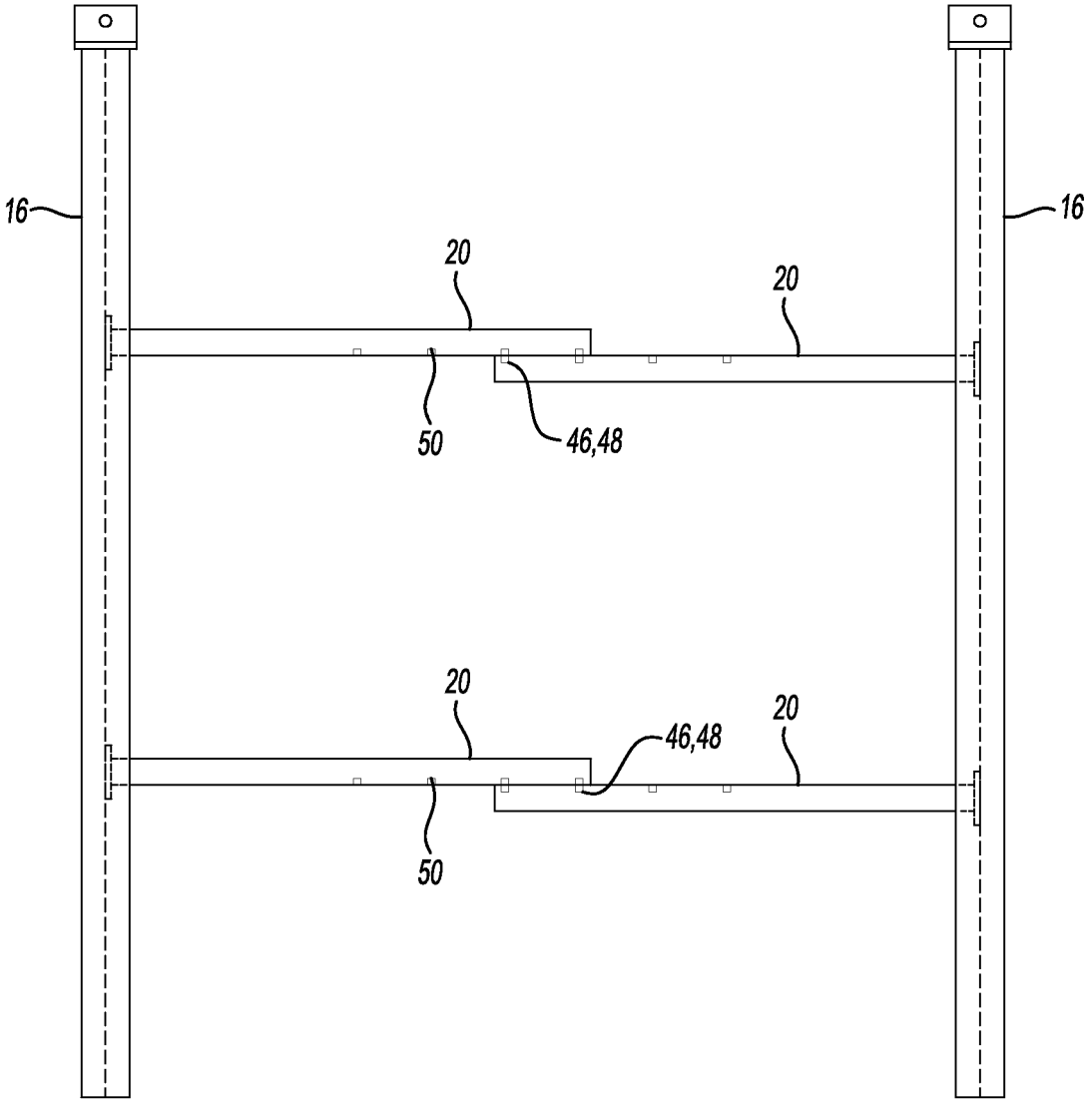
FIG. 7 is a plan view of an embodiment of the lifting and storage apparatus including adjustable cross members.
Figure 8:
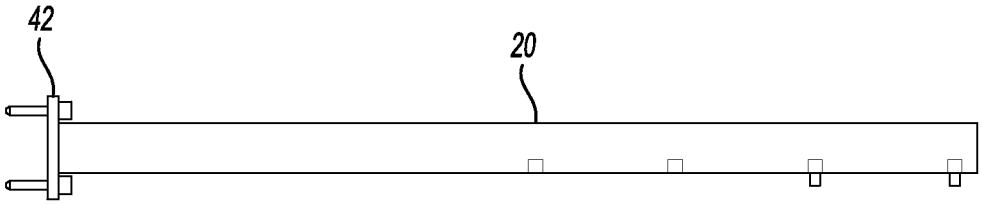
FIG. 8 is a plan view of a cross member of FIG. 6.

In use, the lifting and storage apparatus 12 may be positioned on the surface 18, such as a floor of a garage or other building, on a gravel surface or other surface. The rails 16 may be attached to the surface 18 utilizing a fastener 22 as described in above with FIGS. 1 and 6 or through the use of a non-skid material as described above. The rails 16 may include cross members 20 as shown in FIG. 7 or they not include cross members. The rails 16 may be positioned parallel to each other a specified distance apart as will be needed for a particular trailer. The rails 16 and cross members 20 may be adjusted to the specified width should the rails 16 include cross members 20.

Figure 9:
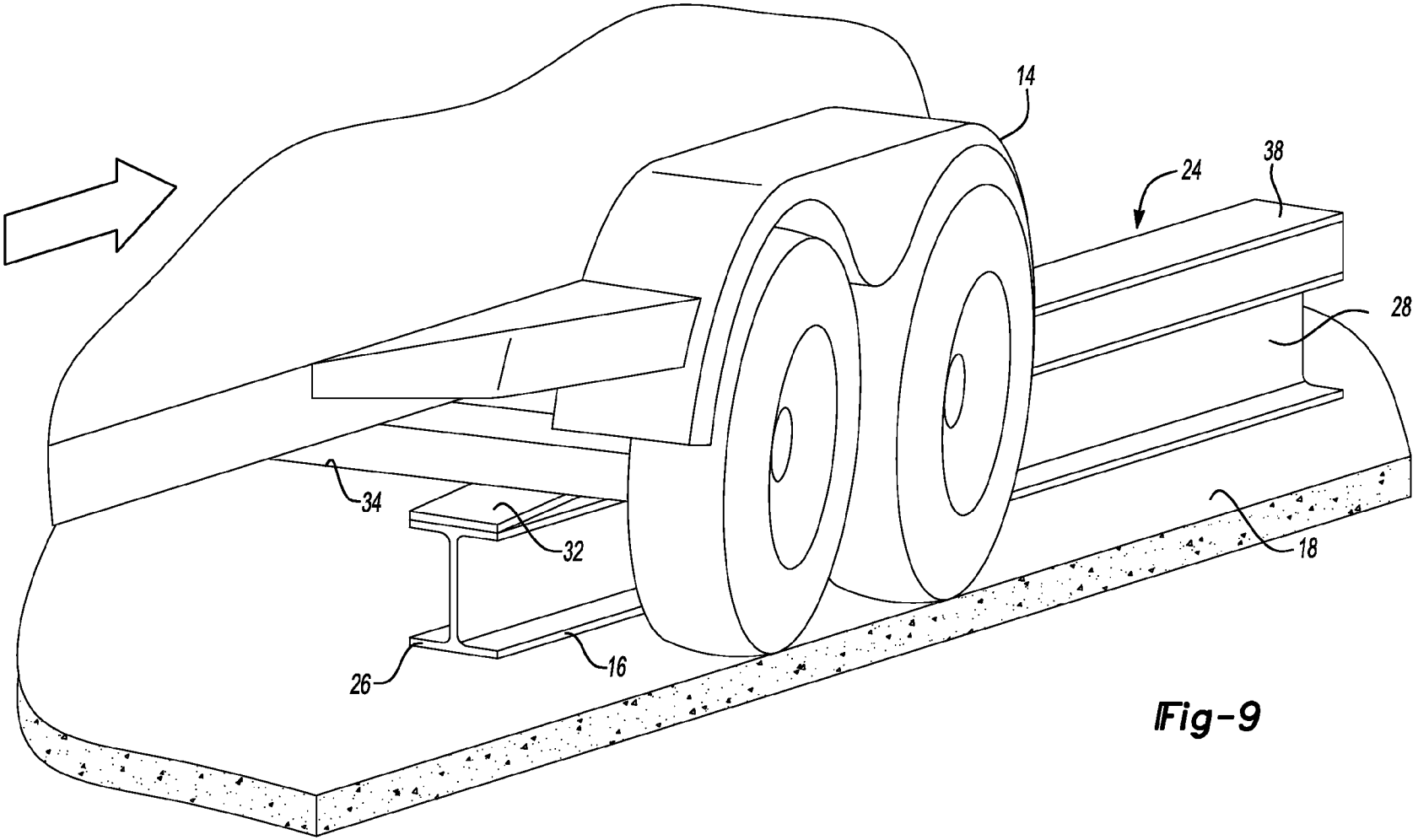
FIG. 9 is a perspective pictorial view of a trailer at a proximal position on the lifting and storage apparatus.

A user may back up a trailer 14 as shown in FIG. 9 such that the trailer axle 34 contacts the proximal end 26 of the top surface 24 and begins traveling up the ramp 32 toward the middle portion 30 of the top surface 24. As the trailer proceeds up the ramp 32 the wheels and tires are lifted relative to the surface 18 such that the load is applied to the axle 34 and removed from the wheels.

Figure 10:
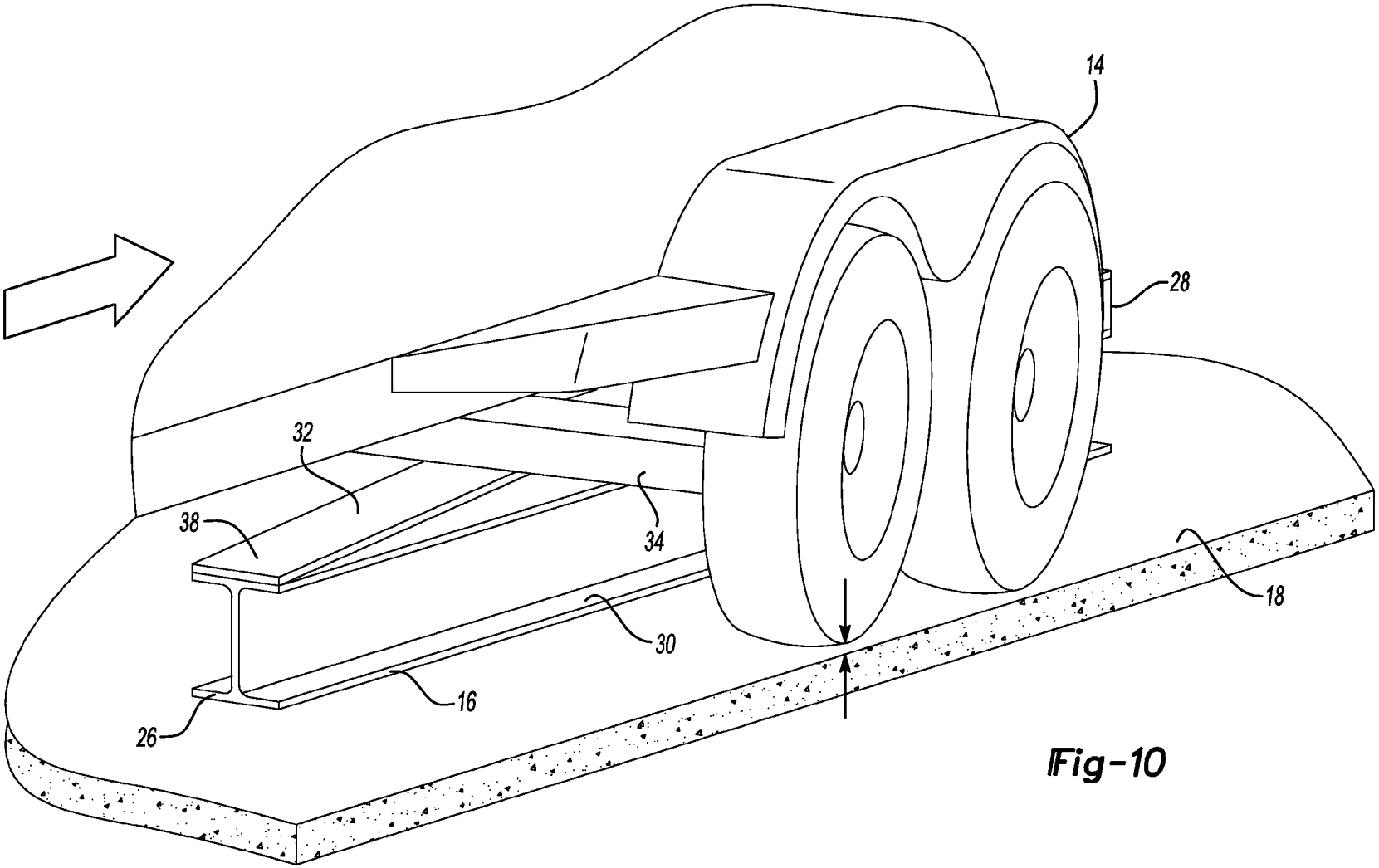
FIG. 10 is a perspective pictorial view of a trailer at a middle position on the lifting and storage apparatus.
Figure 11:
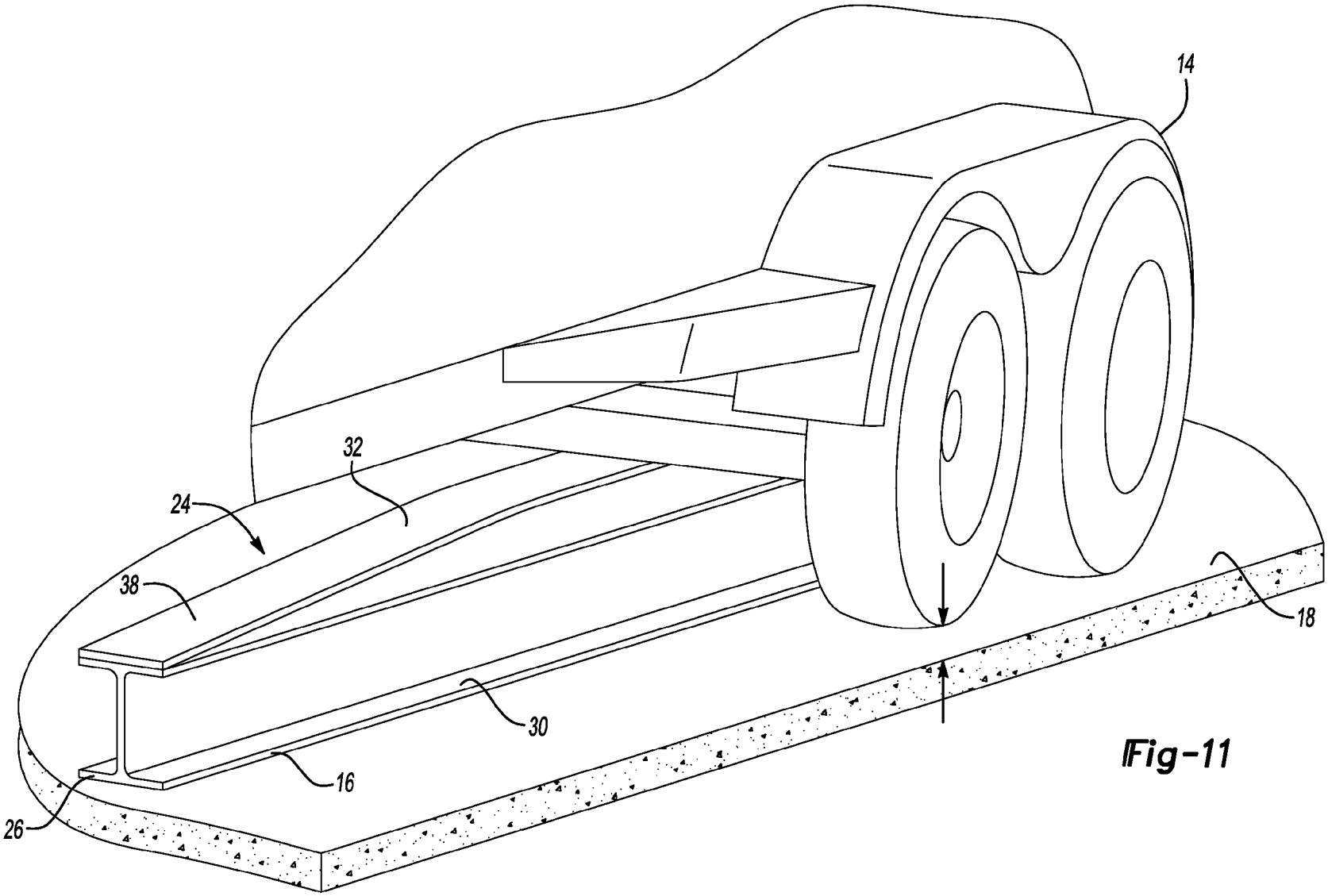
FIG. 11 is a perspective pictorial view of a trailer at a distal position on the lifting and storage apparatus.

As the trailer axle 34 continues its travel up the ramp 32, the trailer axle 34 reaches the middle portion 30 of the top surface 24 and the wheels and tires and lifted from the surface 18 as shown in FIG. 10. The axle 34 continues to slide on the sliding plate 38 until it reaches the distal end 28 of the top surface 24 as shown in FIG. 11. In this manner the load of the trailer 14 and any other structure on the trailer is removed from the wheels and tires to prevent deformation and degradation of the wheels, bearing and tires.

The invention is not restricted to the illustrative examples described above. Examples described are not intended to limit the scope of the invention. Changes therein, other combinations of elements, and other uses will occur to those skilled in the art. The scope of the invention is defined by the scope of the claims.

Having described the invention, I claim:

1. A lifting and storage assembly for a trailer, comprising: a pair of spaced parallel rails disposed on a surface, the rails contacting and supporting an axle of the trailer wherein the wheels of the trailer are lifted above the surface removing a load on the wheels and tires associated with the wheels and wherein each of the pair of spaced rails includes a contoured top surface, the contoured top surface extending from a proximal end to a distal end with a middle portion positioned there between wherein the distal end of the contoured top surface includes a stop formed thereon limiting the travel of the axle along the rail.

2. The lifting and storage assembly of claim 1 wherein the proximal end of the contoured top surface includes a ramped structure including an angle defining a travel path of the axle on the contoured top surface.

3. The lifting and storage assembly of claim 1 wherein the proximal end of the contoured top surface terminates at a radius that transition to the middle portion, the middle portion having a planar surface.

4. The lifting and storage assembly of claim 1 wherein each of the rails includes an extension member attached thereon on a top surface increasing the height of the rail.

5. The lifting and storage assembly of claim 1 including fasteners connecting the rails to the surface.

6. The lifting and storage assembly of claim 1 wherein the contoured top surface includes a sliding plate attached thereon, the sliding plate formed of a material that lessens a frictional coefficient of the top surface and axle allowing smooth travel of the axle along the rail.

7. The lifting and storage assembly of claim 1 including at least one cross member attached to each of the pair of spaced parallel rails and connecting the pair of spaced parallel rails.

8. The lifting and storage assembly of claim 7 wherein the at least one cross member is adjustable changing spacing between the pair of spaced parallel rails.

9. The lifting and storage assembly of claim 7 including angled members connected to the rail and the at least one cross member.

10. The lifting and storage assembly of claim 7 including two cross members attached to each of the pair of spaced parallel rails and connecting the pair of spaced parallel rails.

11. The lifting and storage assembly of claim 7 wherein the at least one cross member includes slots formed therein receiving a fastener adjustably connecting the at least one cross member on each of the pair of spaced rails.

12. A lifting and storage assembly for a trailer, comprising: a pair of spaced parallel rails disposed on a surface, the rails contacting and supporting an axle of the trailer wherein the wheels of the trailer are lifted above the surface removing a load on the wheels and tires associated with the wheels, each of the pair of spaced rails including a contoured top surface, the contoured top surface extending from a proximal end to a distal end with a middle portion positioned there between wherein the contoured top surface includes a sliding plate attached thereon, the sliding plate formed of a material that lessens a frictional coefficient of the top surface and axle allowing smooth travel of the axle along the rail.

13. A lifting and storage assembly for a trailer, comprising: a pair of spaced parallel rails disposed on a surface, the rails contacting and supporting an axle of the trailer wherein the wheels of the trailer are lifted above the surface removing a load on the wheels and tires associated with the wheels and including at least one cross member attached to each of the pair of spaced parallel rails and connecting the pair of spaced parallel rails wherein the at least one cross member includes slots formed therein receiving a fastener adjustably connecting the at least one cross member on each of the pair of spaced rails.

* * * * *